US011545315B1

(12) United States Patent
Aaron et al.

(10) Patent No.: US 11,545,315 B1
(45) Date of Patent: Jan. 3, 2023

(54) OUTDOOR AND/OR WATERPROOF SWITCH

(71) Applicant: Leviton Manufacturing Co., Inc., Melville, NY (US)

(72) Inventors: Stephen Aaron, East Patchogue, NY (US); Michael Kamor, North Massapequa, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 17/582,073

(22) Filed: Jan. 24, 2022

(51) Int. Cl.

| | |
|---|---|
| ***H01H 23/06*** | (2006.01) |
| ***H01H 9/04*** | (2006.01) |
| ***H01H 23/16*** | (2006.01) |
| ***H01H 23/08*** | (2006.01) |
| ***H01H 23/24*** | (2006.01) |

(52) U.S. Cl.
CPC ..... *H01H 9/04* (2013.01); *H01H 23/08* (2013.01); *H01H 23/16* (2013.01); *H01H 23/24* (2013.01)

(58) Field of Classification Search
CPC ..... H01H 23/06; H01H 23/143; H01H 23/30; H01H 23/025; H01H 2300/03; H01H 23/145; H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26; H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20

See application file for complete search history.

(56) References Cited

U.S. PATENT DOCUMENTS

| | | | | |
|---|---|---|---|---|
| 3,030,479 | A | 4/1962 | Maximilian | |
| 3,770,920 | A | 11/1973 | Poliak | |
| 4,704,656 | A | 11/1987 | Neiger | |
| 5,384,441 | A | 1/1995 | Balaban et al. | |
| 5,950,812 | A | 9/1999 | Tanacan et al. | |
| 5,967,303 | A | 10/1999 | Kurek et al. | |
| 6,420,669 | B1 | 7/2002 | Shenker et al. | |
| 6,710,273 | B1 * | 3/2004 | Skarlupka ..... | H01H 23/065 200/339 |

(Continued)

*Primary Examiner* — Ahmed M Saeed
(74) *Attorney, Agent, or Firm* — KDB

(57) ABSTRACT

An electrical device such as, for example, an electrical switch is disclosed. The switch being arranged and configured to prevent ingress or intrusion of water, dust, or the like from the external environment thus making the switch particularly suitable for use outdoors or indoors where water and dust are expected. In one embodiment, the switch includes a base or housing, an internal actuator positioned within an internal cavity of the base, an external actuator accessible by a user, a barrier layer positioned between the internal actuator and the external actuator, the barrier layer arranged and configured to seal the internal cavity and the internal actuator, and a magnetic coupling arranged and configured to transfer movement of the external actuator to the internal actuator through the barrier layer.

20 Claims, 17 Drawing Sheets

(56) References Cited

U.S. PATENT DOCUMENTS

| | | | | |
|---|---|---|---|---|
| 6,875,940 | B2 | 4/2005 | Endres et al. | |
| 6,979,790 | B2 | 12/2005 | Endres et al. | |
| 6,979,791 | B2 | 12/2005 | Endres et al. | |
| 7,030,318 | B2 | 4/2006 | Tufano et al. | |
| 7,034,236 | B2 | 4/2006 | Endres et al. | |
| 7,122,754 | B2 | 10/2006 | Endres et al. | |
| 7,126,070 | B2 | 10/2006 | Endres et al. | |
| 7,176,380 | B2 | 2/2007 | Tufano et al. | |
| 7,230,183 | B2 | 6/2007 | Oddsen et al. | |
| 7,244,891 | B2 | 7/2007 | Schmieta et al. | |
| 7,247,792 | B2 | 7/2007 | Tufano et al. | |
| 7,250,580 | B2 | 7/2007 | Kurek et al. | |
| 7,265,308 | B2 | 9/2007 | Endres et al. | |
| 7,279,636 | B2 | 10/2007 | Oddsen et al. | |
| 7,282,642 | B2 | 10/2007 | Schmieta et al. | |
| 7,285,723 | B2 | 10/2007 | Lindenstraus et al. | |
| 7,294,782 | B2 | 11/2007 | Lindenstraus et al. | |
| 7,435,903 | B2 | 10/2008 | Tufano et al. | |
| 7,456,360 | B2 | 11/2008 | Schmieta et al. | |
| 7,700,888 | B2 | 4/2010 | Kurek et al. | |
| 7,732,710 | B2 | 6/2010 | Oddsen et al. | |
| RE43,156 | E | 2/2012 | Lindenstraus et al. | |
| 8,592,681 | B2 | 11/2013 | Alderson et al. | |
| 8,822,859 | B2 | 9/2014 | Hoffman et al. | |
| 9,082,569 | B2 | 7/2015 | Alderson et al. | |
| 9,425,008 | B1 * | 8/2016 | Lee | H03K 17/97 |
| 10,243,606 | B1 * | 3/2019 | Miehl | H01H 13/14 |
| 2003/0226678 | A1 | 12/2003 | Oddsen et al. | |
| 2006/0100485 | A1 * | 5/2006 | Arai | A61B 1/00068 600/101 |
| 2007/0212953 | A1 | 9/2007 | Lindenstraus et al. | |
| 2008/0035459 | A1 | 2/2008 | Endres et al. | |

* cited by examiner

OUTDOOR AND/OR WATERPROOF SWITCH

FIELD OF THE DISCLOSURE

The present disclosure relates generally to electrical devices, and more particularly to an electrical switch arranged and configured to prevent ingress of water, dust, or the like from the external environment.

BACKGROUND OF THE DISCLOSURE

Generally speaking, electrical devices such as, for example, electrical switches, dimmers, etc. are well known in the industry. Electrical switches may include a housing for enclosing electrical and/or energized circuitry/components and an actuator accessible by a user for controlling an associated electrical load such as, for example, an actuator for turning a lighting load ON, OFF, etc. As will be readily appreciated by one of ordinary skill in the art, movement of the actuator is generally transmitted to a switching mechanism positioned within the housing for controlling the associated electrical load. For example, moving the actuator from a first or OFF position to a second or ON position may turn the associated electrical load ON. Generally speaking, the actuator is coupled to the switching mechanism through interacting components extending through an opening formed in a front surface of the housing, which allows for water, dust, etc. to enter the housing of the electrical switch and to potentially contact the internal components of the switch including, for example, the energized components, the switching mechanism, etc. potentially rendering the electrical switch inoperative and/or unsafe.

Thus, it would be beneficial to incorporate a mechanism or barrier that completely inhibits any moisture, dust, etc. from the external environment from entering into the housing of the electrical switch. Thus arranged, the electrical switch is ideally suited for use outdoors or indoor environments (e.g., clean rooms, food industry, etc.) where moisture, dust, or the like is expected.

It is with respect to these and other considerations that the present improvements may be useful.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an electrical device such as, for example, an electrical switch. In one embodiment, the electrical switch includes a housing or a base including an internal cavity or volume for housing internal components such as, for example, terminals or leads for receiving power and a switching mechanism for selectively energizing and de-energizing an associated, connected electrical load. The switch further including an internal actuator positioned within the internal cavity of the base, an external actuator accessible by a user, and a barrier positioned between the internal actuator and the external actuator, the barrier arranged and configured to cover an opening of the base to seal the internal cavity and internal actuator from water, dust, etc. The external actuator and the internal actuator including a magnetic coupling arranged and configured to transfer movement of the external actuator to the internal actuator through the barrier layer.

In one embodiment, an electrical device id is disclosed. The electrical device including a base including an opening and a cavity, an internal actuator positioned at least partially within the cavity of the base, an external actuator accessible by a user, a barrier positioned between the internal actuator and the external actuator, the barrier arranged and configured to cover the opening of the base, the barrier configured to seal the cavity to prevent ingress of water and dust, and a magnet coupled to one or both of the internal actuator and the external actuator, wherein the magnet is arranged and configured to magnetically couple the internal actuator and the external actuator, wherein upon movement of the external actuator, the magnetic coupling causes movement of the internal actuator.

In one embodiment, the external actuator is moveable between a first position and a second position and the internal actuator is moveable between a first position and a second position, wherein movement of the external actuator between the first and second positions causes the internal actuator to move between its respective first and second positions.

In one embodiment, the electrical device is an electrical switch and the external actuator is one of an external rocker, an external paddle, or a toggle, the external actuator being manually moveable between the first and second positions to selectively energize and de-energize an electrical load coupled to the electrical device.

In one embodiment, the electrical device is an electrical switch, the external actuator is an external slider, and the internal actuator is an internal slider; wherein upon movement of the external slider, the magnetic coupling causes movement of the internal slider between the first and second positions to control an electrical load coupled to the electrical device.

In one embodiment, wherein the electrical device is an electrical switch, the external actuator is a rotary actuator rotatable between the first and second positions to selectively energize and de-energize an electrical load coupled to the electrical device.

In one embodiment, the magnet further includes a first magnet coupled to the external actuator and a second magnet coupled to the internal actuator.

In one embodiment, the magnet further includes first and second magnets coupled to the external actuator and third and fourth magnets coupled to the internal actuator.

In one embodiment, the first magnet is arranged and configured to repel the third magnet and the second magnet is arranged and configured to repel the fourth magnet.

In one embodiment, the first magnet is arranged and configured to attract the third magnet and the second magnet is arranged and configured to attract the fourth magnet.

In one embodiment, the electrical device further includes a frame coupled to the base, wherein the internal actuator is coupled to the base and the external actuator is coupled to the frame.

In one embodiment, the frame and the barrier are integrally formed.

In one embodiment, the electrical device further includes a wall-plate arranged and configured to couple the device to an electrical box, the wall-plate being integrally formed with the frame and the barrier.

In one embodiment, the barrier comprises a film or membrane.

In one embodiment, the magnet is a permanent magnet.

In yet another embodiment, an electrical switch is disclosed. The electrical switch includes a base including an opening and a cavity, a switching mechanism positioned with the cavity, the switching mechanism arranged and configured to selectively energize and de-energize an electrical load coupled to the electrical device, an internal actuator positioned within the cavity of the base, an external actuator accessible by a user, the external actuator moveable between a first position and a second position, a barrier positioned between the internal actuator and the external actuator, the barrier arranged and configured to cover the opening of the base, the barrier configured to seal the cavity, and a magnet coupled to one or both of the internal actuator and the external actuator, wherein the magnet is arranged and configured to magnetically couple the internal actuator and the external actuator, wherein upon movement of the external actuator, the magnetic coupling causes movement of the internal actuator between its first and second positions.

In one embodiment, the magnet further includes a first magnet coupled to the external actuator and a second magnet coupled to the internal actuator.

In one embodiment, the magnet further includes first and second magnets coupled to the external actuator and third and fourth magnets coupled to the internal actuator.

In one embodiment, the electrical switch further includes a frame coupled to the base, wherein the internal actuator is coupled to the base and the external actuator is coupled to the frame.

In one embodiment, the frame and the barrier are integrally formed.

In one embodiment, the electrical switch further includes a wall-plate arranged and configured to couple the switch to an electrical box, the wall-plate being integrally formed with the frame and the barrier.

BRIEF DESCRIPTION OF THE DRAWINGS

By way of example, a specific embodiment of the disclosed device will now be described, with reference to the accompanying drawings, in which.

Figure 1:
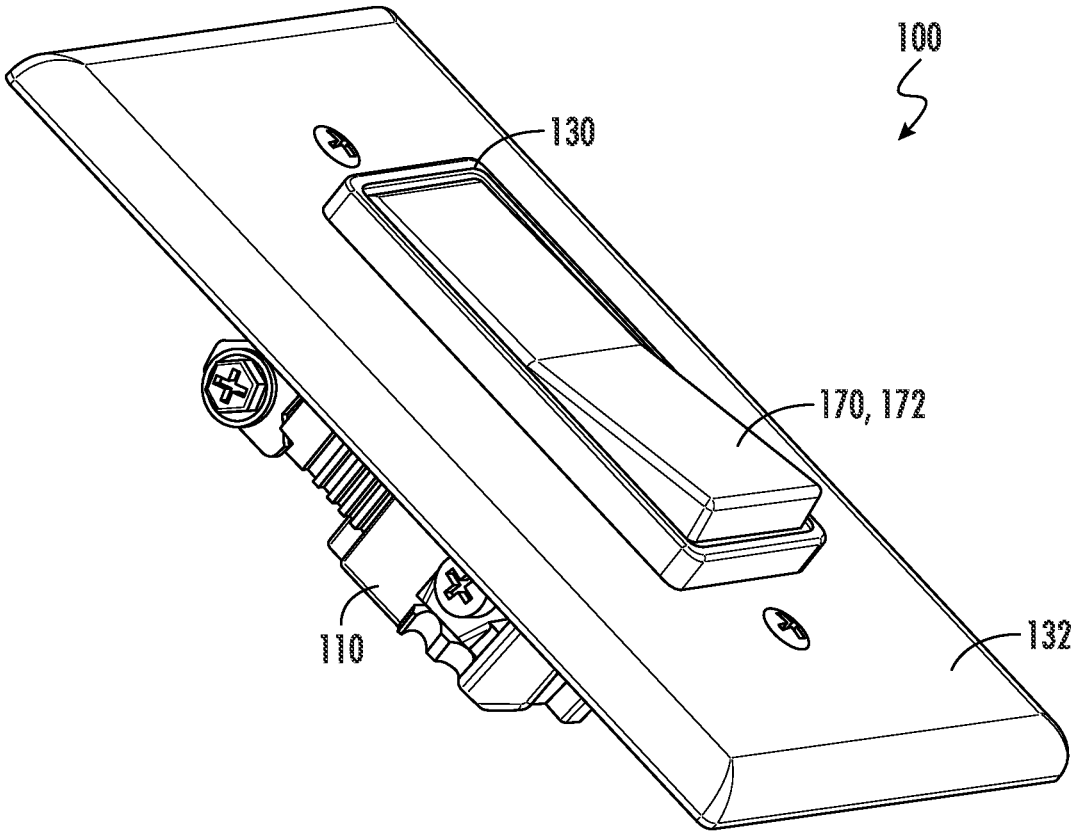
FIG. 1 is a front perspective view of an embodiment of an electrical switch according to the present disclosure.
Figure 2:
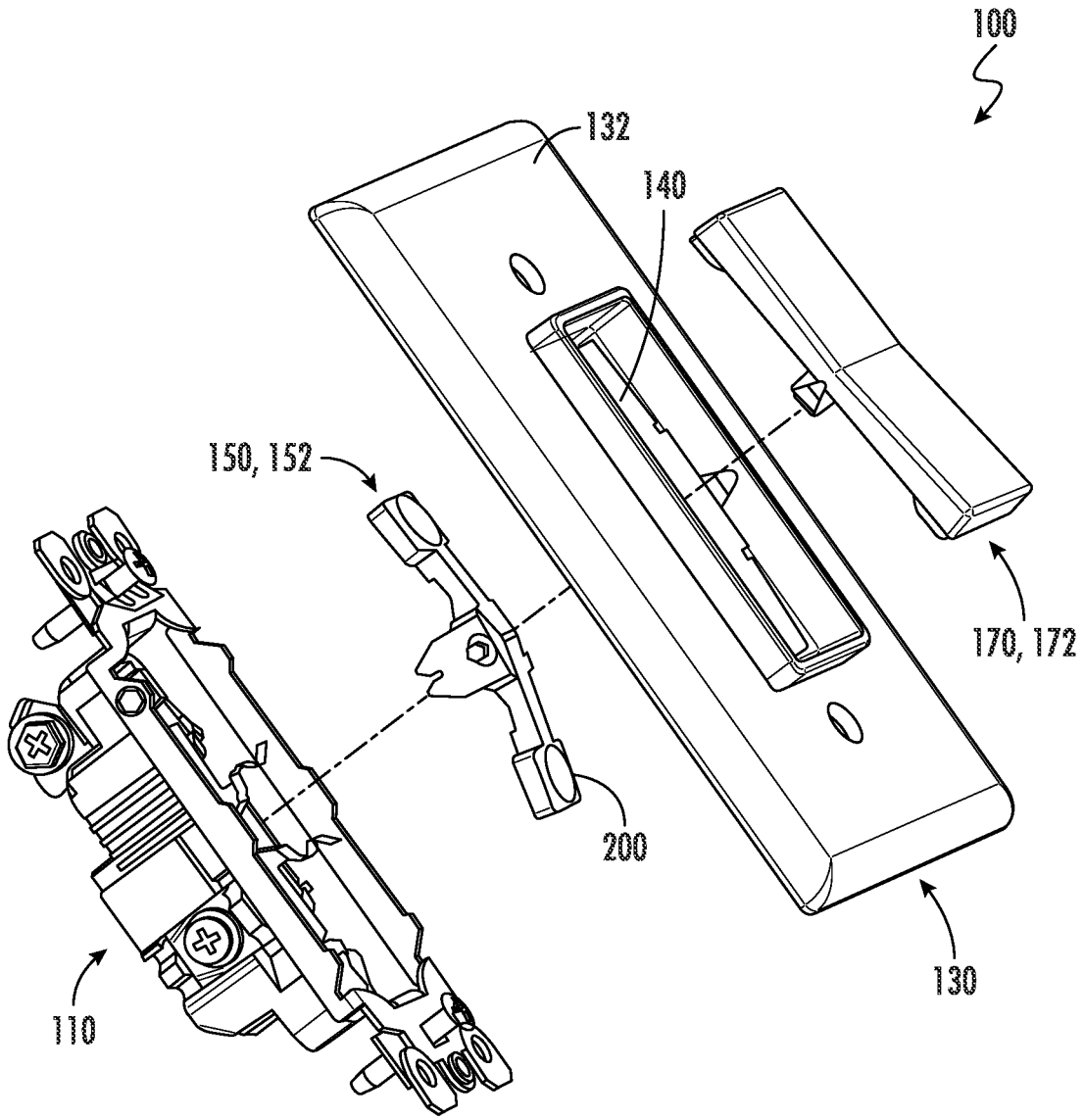
FIG. 2 is an exploded view of the electrical switch shown in FIG. 1.
Figure 3:
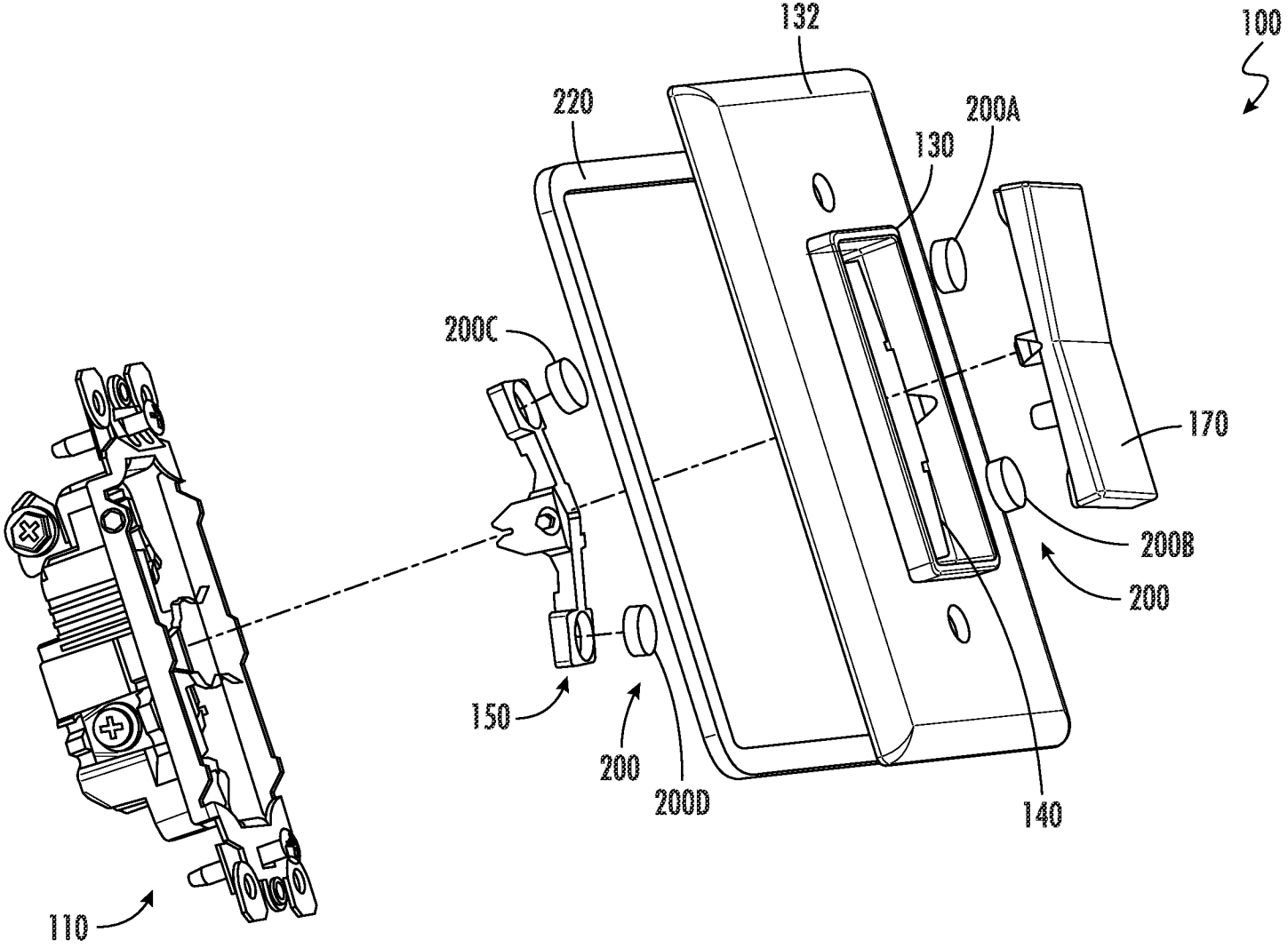
FIG. 3 is an alternate exploded view of the electrical switch shown in FIG. 1.
Figure 4:
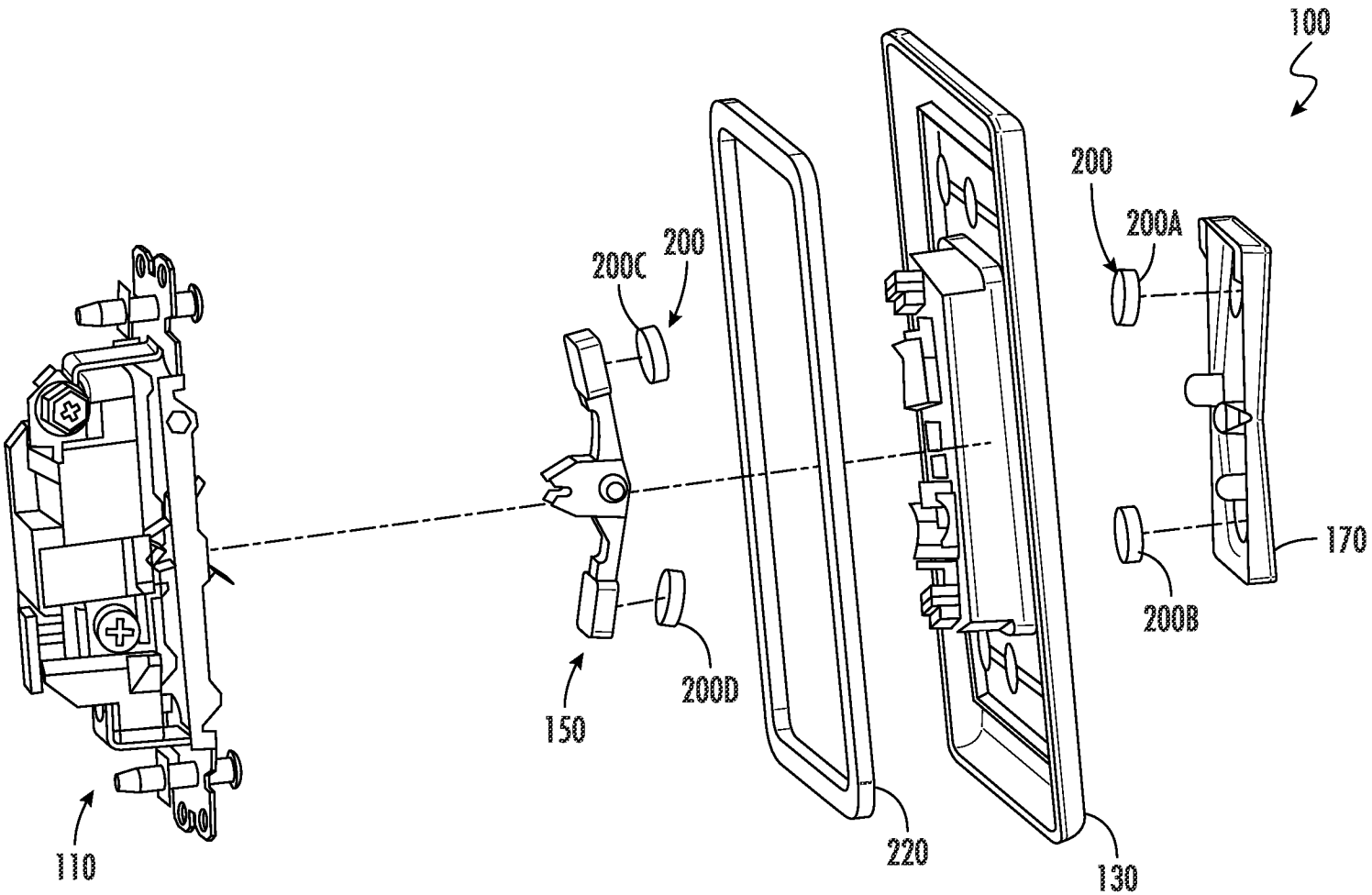
FIG. 4 is an alternate exploded view of the electrical switch shown in FIG. 1.

The drawings are not necessarily to scale. The drawings are merely representations, not intended to portray specific parameters of the disclosure. The drawings are intended to depict example embodiments of the disclosure, and therefore are not to be considered as limiting in scope. In the drawings, like numbering represents like elements.

DETAILED DESCRIPTION

Numerous embodiments of electrical devices such as, for example, electrical switches, will now be described more fully hereinafter with reference to the accompanying drawings, in which preferred embodiments of the present disclosure are presented. In accordance with one or more features of the present disclosure, the electrical switch includes one or more mechanisms or layers arranged and configured to provide a barrier to form a seal to prevent ingress of water, dust, etc. from the external environment into an interior cavity or volume of the housing of the electrical switch. In addition, the electrical switch includes one or more mechanisms or systems for transferring force or movement from an external actuator through the barrier layer to the internal components (e.g., switching mechanism) of the electrical switch.

In connection with the present disclosure, the mechanisms, layers, and/or systems may be embodied in many different forms and should not be construed as being limited to the embodiments set forth herein. Rather, these embodiments are provided so that this disclosure will convey certain features of mechanisms, layers, and/or systems to those skilled in the art.

As will be described in greater detail below, in various embodiments, an electrical switch arranged and configured to control a load such as, for example, a lighting load, will be described. However, the load may be any load now known or hereafter developed, such as, for example, a lighting load, a motor, a fan, etc. In use, the electrical switch may be arranged and configured to turn the load ON, OFF, or the like. Features of the present disclosure may be used in combination with numerous different embodiments of electrical switches. As such, the features of the present disclosure should not be limited to any particular type or configuration of switch or associated load.

As will be described herein, the electrical switch may include a housing or base (terms used interchangeably without the intent to limit or distinguish) for holding, enclosing, or the like, electrical circuitry and/or internal components, an actuator (e.g., a manual actuator, a rocker, a paddle, a button, a toggle switch, a rotary switch, etc.) accessible by a user for controlling the associated electrical load, a barrier layer arranged and configured to seal the internal components and/or circuitry of the base from the external environment, and a mechanism or system (e.g., magnets) for transferring movement of the actuator to the internal components and/or circuitry through the barrier layer for selectively controlling the associated load. Various types of magnets may be used such as temporary magnets, permanent magnets, electromagnets with cores, or electromagnets without cores.

That is, as will be described in greater detail herein, in one embodiment, the switch includes a plurality of magnets coupled to an exterior actuator, which is accessible by a user, an internal actuator including a plurality of magnets, which when assembled interact with the magnets coupled to the exterior actuator, and a barrier layer positioned between the exterior actuator and the internal actuator, the barrier layer providing a seal against ingress of water, dust, etc. into the interior cavity or volume of the base. In use, the magnets formed on the exterior actuator are arranged and configured to interact through the barrier layer so that when a user manipulates the exterior actuator (e.g., moves or presses the exterior actuator), the exterior actuator drives the internal actuator, which drives the switching mechanism. The barrier layer preventing moisture, dust, etc. from reaching the internal components of the switch, thus allowing the switch to be used outdoors and/or indoors where moisture, dust, etc. are expected.

As will be described in greater detail herein, in one embodiment, the housing may include a base and a frame. In one embodiment, the base forms a cavity or volume for receiving the internal components and/or circuitry including, inter alia, leads or terminals for receiving power and a switching mechanism for selectively energizing and de-energizing the associated electrical load, as will be readily appreciated by one of ordinary skill in the art. In one or more embodiments described herein, the frame may be integrated with the wall plate and the barrier layer to create a waterproof/dustproof barrier layer to prevent the ingress of water, dust, etc. from the external environment.

The actuator may be any now known or hereafter developed actuator. For example, the actuator could be a rocker, a paddle, a toggle, a button, a rotary switch, etc. (terms used interchangeably herein without the intent to limit) moveable between a first position and a second position.

Figure 15A:
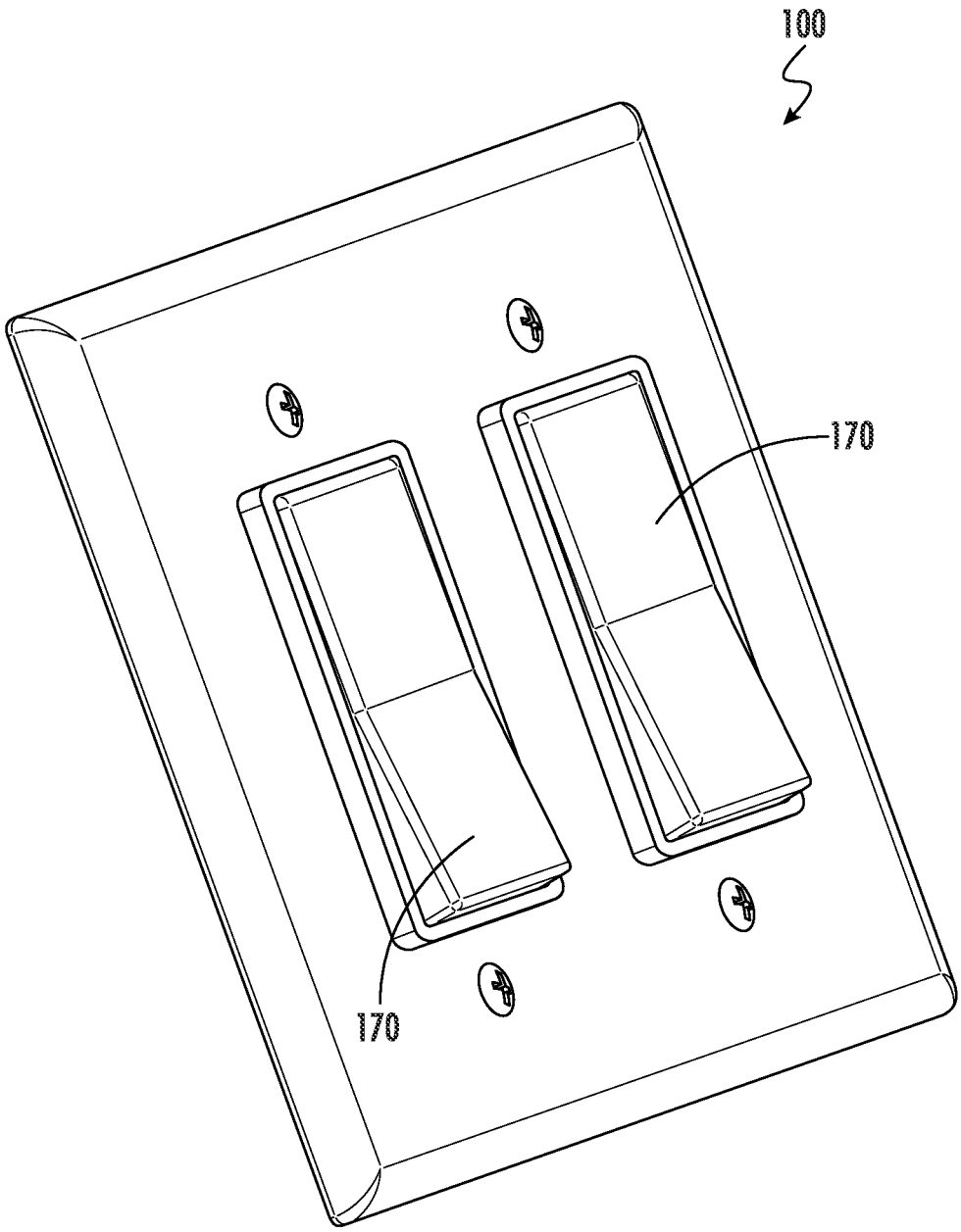
FIGS. 15A and 15B illustrate various views of an electrical switch in accordance with the present disclosure arranged in a multi-gang configuration.
Figure 15B:
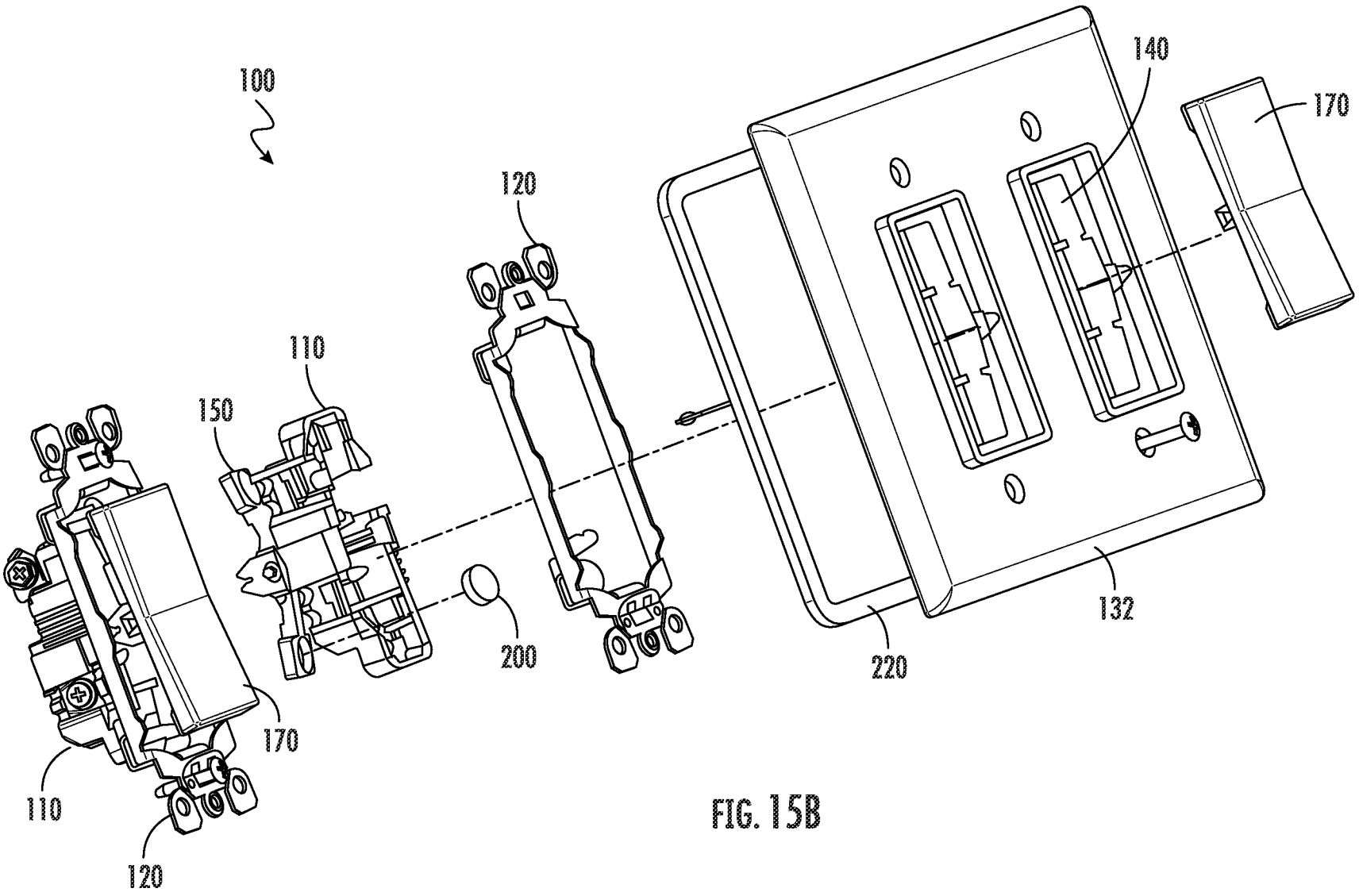

In use, as will be described and generally illustrated, the electrical switches may be arranged and configured to be mounted to an electrical box such as, for example, a single gang electrical box. However, with reference to FIGS. 15A and 15B, the electrical switches may be used in a multi-gang electrical box. In a multi-gang configuration, the wall plate may include multiple, distinct, integrated frames, each with their own barrier layer and corresponding distinct external actuators, internal actuators, housings, and internal energized components and wiring methods.

In accordance with one or more features of the present disclosure, the electrical switch incorporates one or more mechanisms or layers arranged and configured to provide a waterproof seal, a dustproof seal, etc. to prevent ingress of water, dust, etc. from the external environment into the internal cavity or volume of the housing. In one embodiment, the barrier layer may be incorporated into an integrated wall plate and frame component. In addition, the electrical switch may include one or more mechanisms for transferring movement of an external actuator to the internal components and/or circuitry of the switch through the barrier layer. For example, in one embodiment, a set of magnets may be associated with the external actuator and a set of magnets may be associated with an internal actuator, which is associated with the internal components. During use, movement of the external actuator is transferred to the internal components via the set of magnets. Thus arranged, movement of the external actuator is transferred through the barrier layer to the internal actuator, and hence internal switching mechanism, thereby enabling an improved waterproof/dustproof seal.

In accordance with the present disclosure, while mechanisms and/or layers for creating a waterproof/dustproof seal and/or mechanisms and/or systems for transferring movement from the external actuator through the waterproof/dustproof seal will be described and illustrated in connection with particular embodiments of the electrical switch, it should be appreciated that mechanisms, systems, and/or layers may be used in connection with any electrical device now known or hereafter developed. As such, while the present disclosure will be described in connection with particular embodiments, the present disclosure should not be limited to any particular type of electrical switch or device unless specifically claimed.

Referring to FIGS. 1-6, an embodiment of an electrical switch 100 according to the present disclosure is shown. As illustrated, in one embodiment, the switch 100 includes a base 110, a frame 130, an internal actuator 150 such as, for example, an internal rocker 152, and an external actuator 170 such as, for example, an external rocker or paddle 172.

Figure 5:
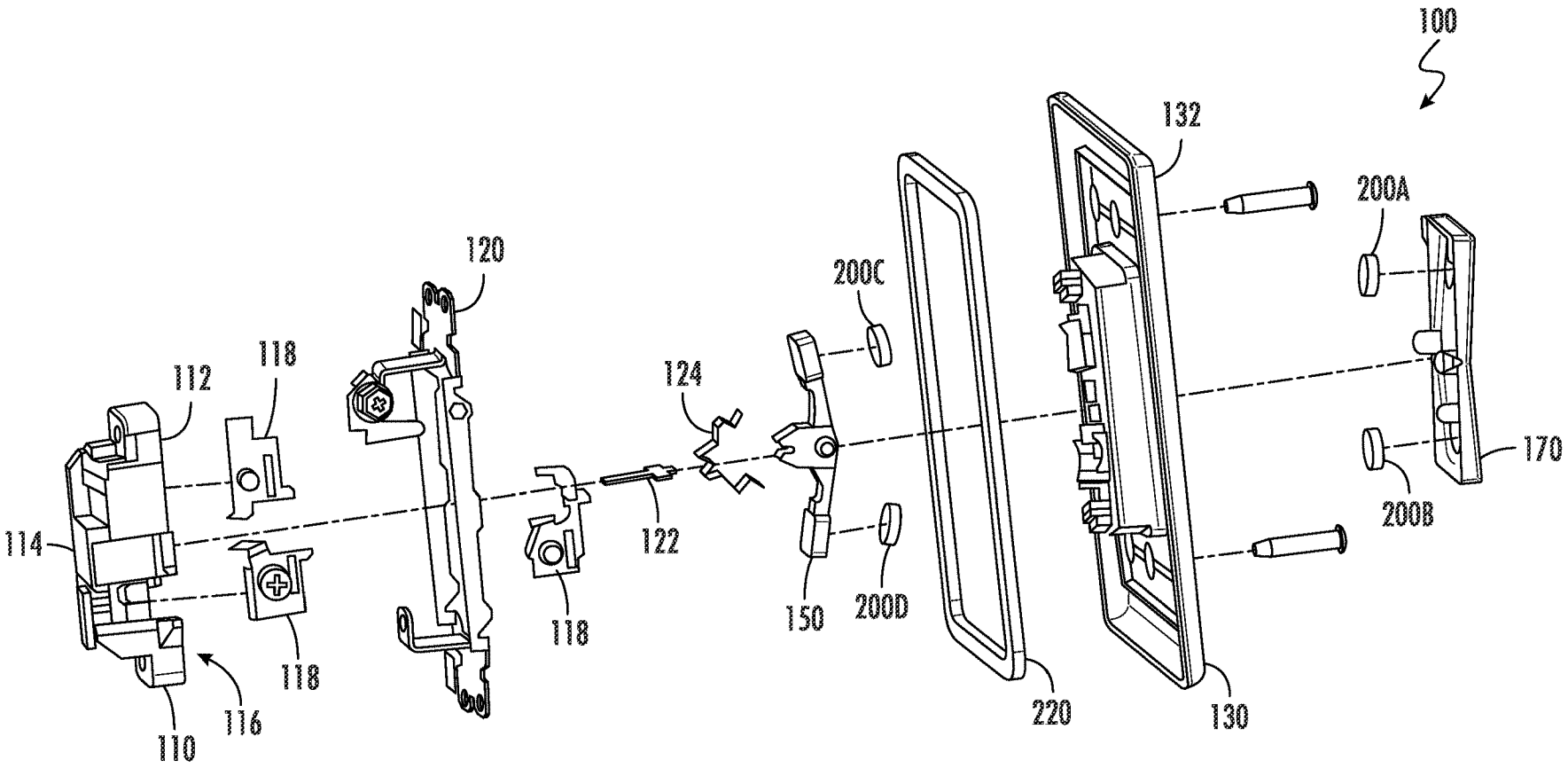
FIG. 5 is an alternate exploded view of the electrical switch shown in FIG. 1.
Figure 6:
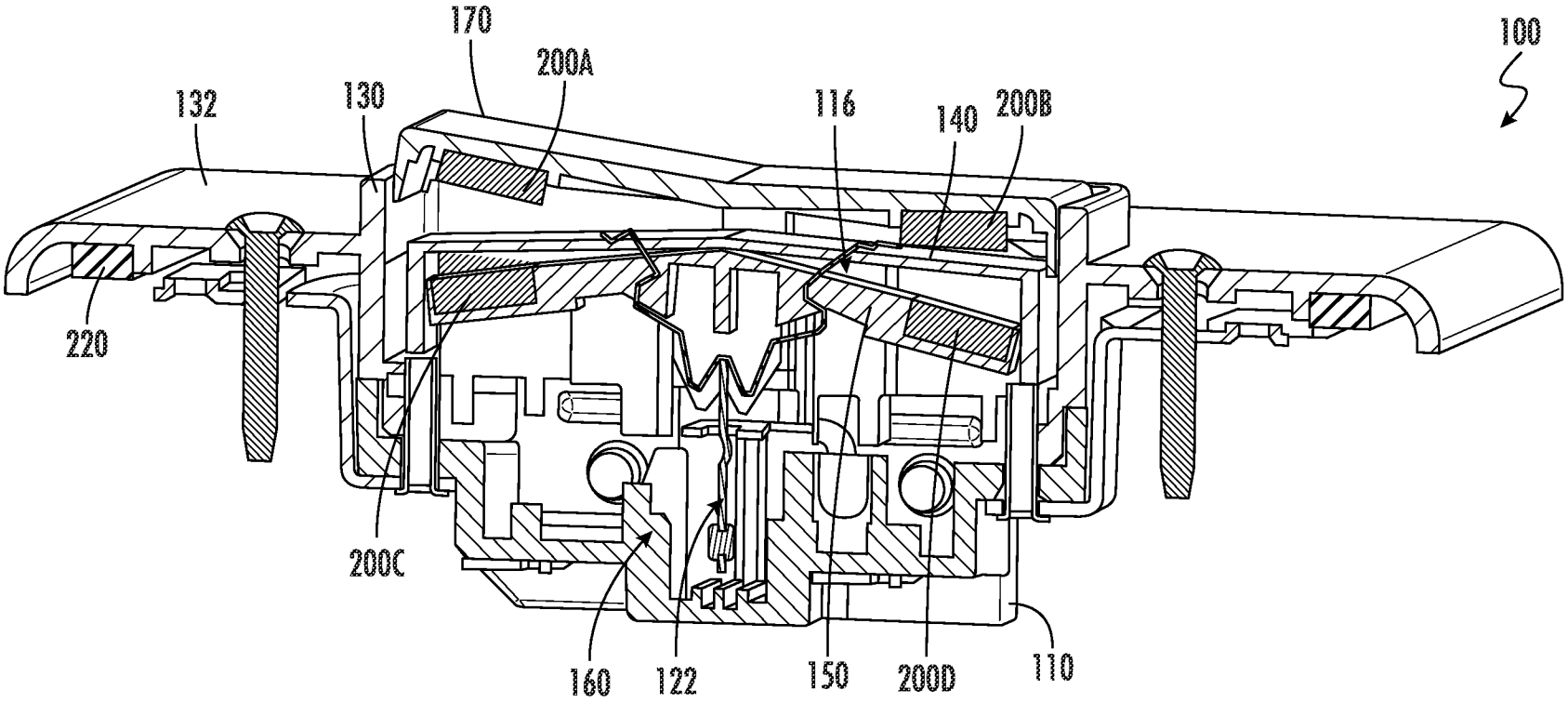
FIG. 6 is a cross-sectional view of the electrical switch shown in FIG. 1.
Figure 7:
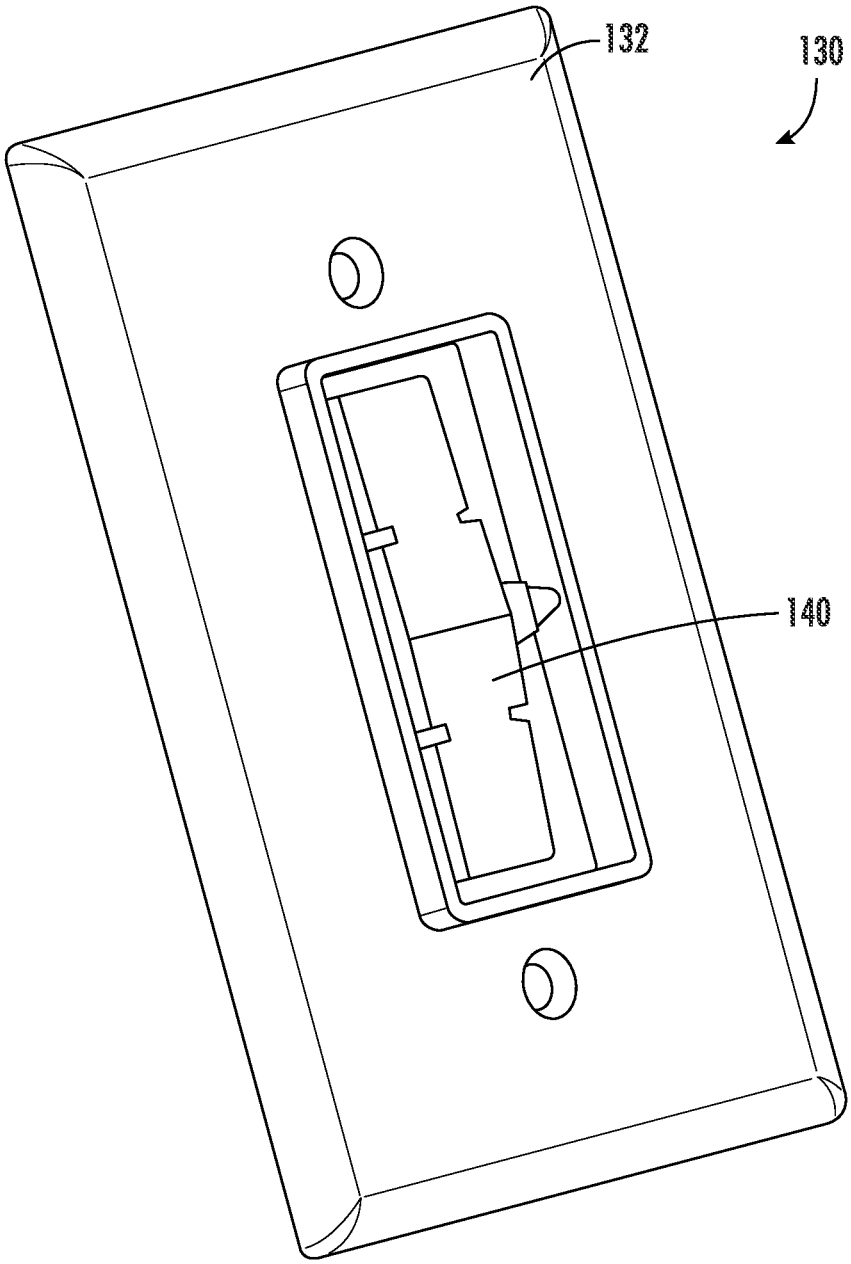
FIG. 7 is a front perspective view of an embodiment of an integrated frame, wall-plate, and barrier layer that may be used in the electrical switch shown in FIG. 1 in accordance with one or more features of the present disclosure.

In one embodiment, the base 110 may include a front surface 112 and a rear surface 114 (FIG. 5). In use, as will be readily appreciated by one of ordinary skill in the art, the base 110 includes an interior cavity or volume 116 (FIG. 5) to contain all, or at least portions, of the components and/or circuitry needed for the switch 100 to receive power and to selectively control (e.g., energize and/or de-energize) an associated electrical load coupled to the switch 100 (e.g., the base 110 is arranged and configured to include terminals and/or leads arranged and configured to receive power such as, for example, line-voltage power, and a switching mechanism arranged and configured to selectively energize and de-energize an associated load). For example, as illustrated in the example embodiment, the base 110 may include terminals 118 (e.g., line terminals, load terminals, etc.), a strap assembly 120, a brush 122, a biasing spring 124, etc. In use, the construction of the base 110 including the internal components and/or circuitry housed therein are well known to those of ordinary skill in the art. Thus, for the sake of brevity, additional discussion on the base 110 and internal components and/or circuitry thereof, are omitted herefrom. In use, the electrical switch 100 may include any base 110 and/or internal components/circuitry now known or hereafter developed. As such, the present disclosure should not be limited to any particular type of base and/or internal components/circuitry unless explicitly claimed.

In accordance with one or more features of the present disclosure, the switch 110 includes a frame 130 arranged and configured to contact, engage, etc. the base 110. In addition, the frame 130 may be arranged and configured to couple to the external actuator 170 such as, for example, pivotably engage the external rocker or paddle 172 so that the external actuator 170 can move (e.g., pivot) between first and second positions. In one embodiment, as illustrated, the frame 130 may be integrally manufactured with a wall-plate 132, which is arranged and configured to couple the switch 100 to, for example, an electrical box. Thus arranged, the wall-plate 132 is sealed to the frame 130 to prevent ingress or intrusion of water, dust, etc. into the interior cavity or volume 116 of the base 110.

In accordance with one or more features of the present disclosure, as best illustrated in FIGS. 2, 3, 6, and 7, the frame 130 includes a barrier layer 140 arranged and configured to extend across (e.g., cover) the opening to the interior cavity or volume 116 of the base 110 (e.g., the barrier layer 140 is arranged and configured to extend across the opening formed in the front surface 112 of the base 110 to cover the interior cavity 116 of the base 110). Thus arranged, with the frame 130 coupled to the base 110, the internal components and/or circuitry housed within the base 110 are covered by the barrier layer 140 thereby creating a waterproof and/or dustproof seal over the opening to the interior cavity or volume 116 of the base 110. In accordance with the present disclosure, the integrated frame 130, wall-plate 132, and barrier layer 140 may be manufactured from a plastic material. In one embodiment, the integrated frame 130, wall-plate 132, and barrier layer 140 may be manufactured from a rigid plastic, a semi-rigid plastic, or a flexible plastic. However, it is envisioned that the integrated frame 130, wall-plate 132, and barrier layer 140 may be manufactured from other suitable materials now known or hereafter developed. Thus arranged, the integrated frame 130, wall-plate 132, and barrier layer 140 create a waterproof and/or dustproof seal preventing ingress of water, dust, etc. from the external environment. However, this is but one configuration and other configurations may be used. For example, the frame 130, the wall plate 132, and the barrier layer 140 may be separately formed and coupled together. In one embodiment, for example, the barrier layer 140 may be provided as a thin film or membrane. In use, the thin film or membrane could be coupled across the opening of the base to seal the interior cavity or volume of the base 110 from the external environment.

Figure 8:
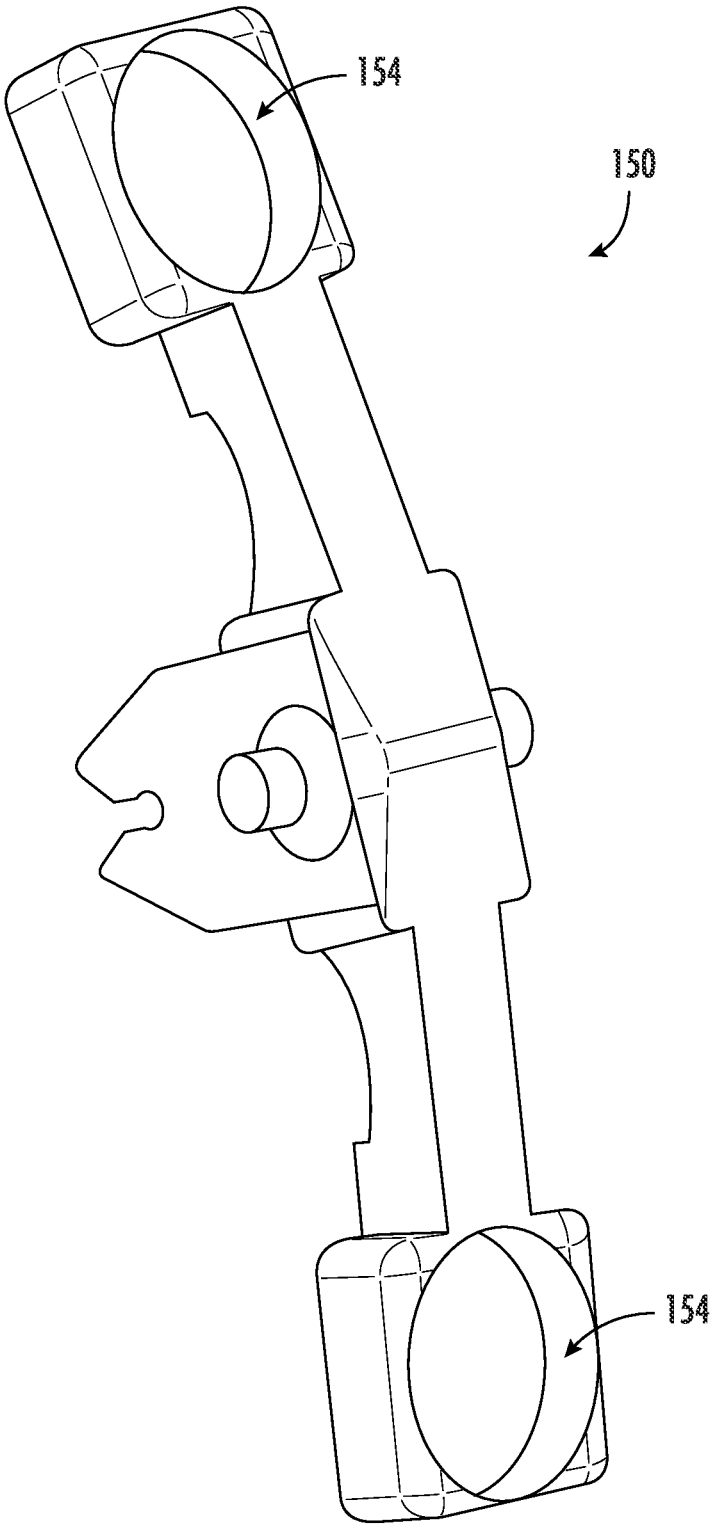
FIG. 8 is a front perspective view of an embodiment of an internal actuator that may be used in the electrical switch shown in FIG. 1 in accordance with one or more features of the present disclosure.
Figure 9:
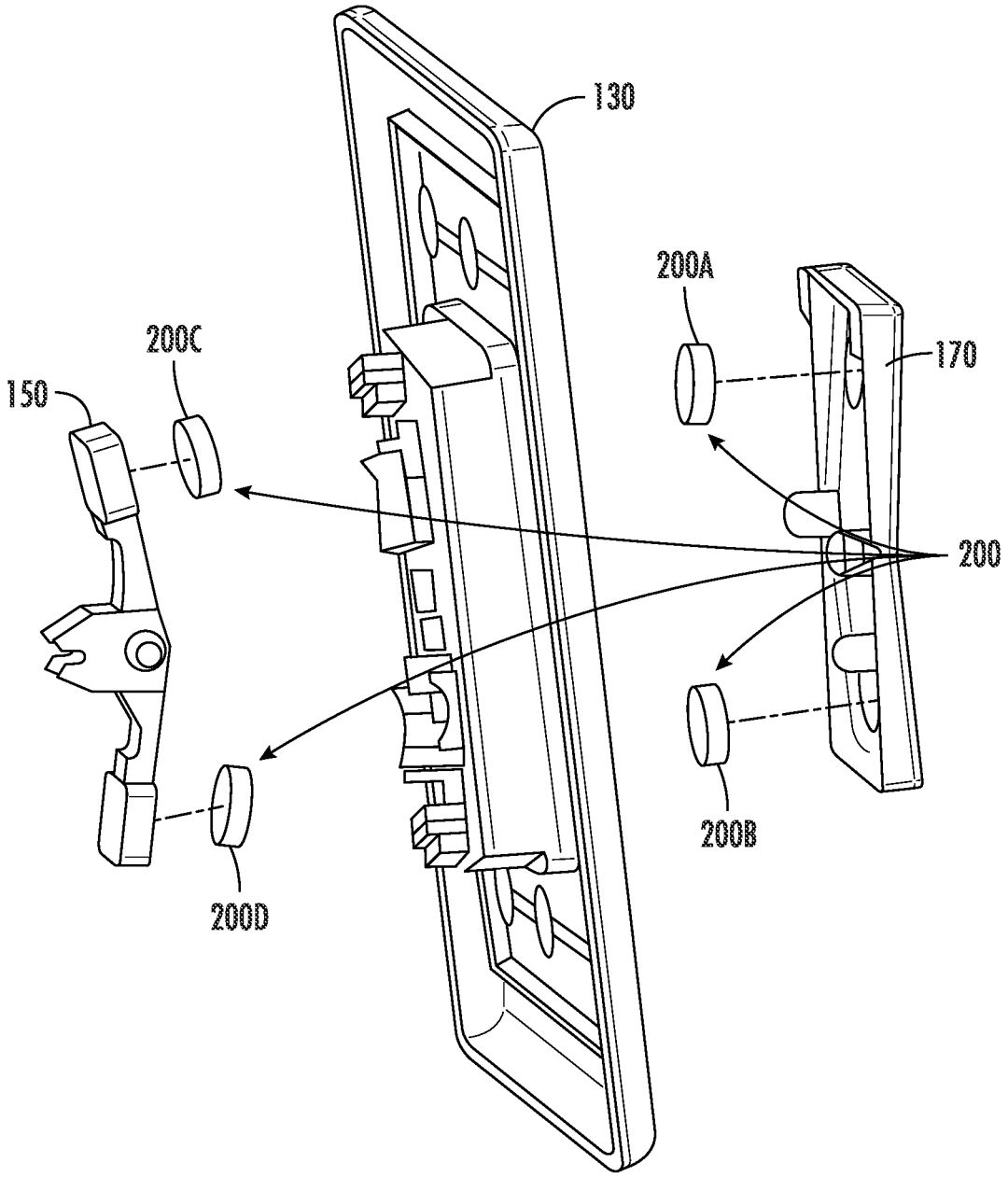
FIG. 9 is an exploded, detailed view of an embodiment of the internal actuator shown in FIG. 8, the integrated frame, wall-plate, and barrier layer shown in FIG. 7, an external actuator, and a magnet coupling mechanism in accordance with one or more features of the present disclosure.

In accordance with one or more features of the present disclosure, as best illustrated in FIG. 2-6, the switch 100 also includes an internal actuator 150. In use, the internal actuator 150 is housed within the interior cavity or volume 116 of the base 110. In addition, the internal actuator 150 is positioned behind the barrier layer 140. Thus arranged, the internal actuator 150 is protected from the external environment by the barrier layer 140. In use, the internal actuator 150 is arranged and configured to interact with the internal components and/or circuitry of the base 110 so that movement of the internal actuator 150 between first and second positions selectively energizes and/or de-energizes the associated load. For example, the internal actuator 150 is arranged and configured to interact with the switching mechanism 160 (FIG. 6) so that movement of the internal actuator 150 from the first or OFF position to the second or ON position selectively energizes the associated load, and vice-versa, movement from the second or ON position to the first or OFF position, selectively de-energizes the associated load. In one embodiment, the internal actuator 150 may be pivoted between the first and second positions. In use, pivoting the internal actuator 150 between the first and second positions moves, for example, the brush 122 (e.g., switching mechanism) to selectively energize/de-energize the associated load. As illustrated in FIG. 8, for reasons that will become apparent below, the internal actuator 150 may include a pair of pockets 154 arranged and configured to receive, couple, etc. a pair of magnets 200.

In additional, in accordance with one or more features of the present disclosure, as best illustrated in FIGS. 1-6, the switch 100 also includes an external actuator 170. In use, the external actuator 170 is accessible by a user (e.g., external actuator 170 can be moved by a user between the first/OFF position and the second/ON position to selectively energize and de-energize the associated load). As illustrated, in one embodiment, the external actuator 170 may be made accessible to the user by extending through an opening formed in the wall-plate 132. In one embodiment, the external actuator 170 may be pivoted between the first and second positions. In one embodiment, the external actuator 170 is pivotable coupled to the frame 130.

In accordance with one or more features of the present disclosure, as best illustrated in FIGS. 2-6 and 9, the switch 100 also includes a mechanism for coupling the external actuator 170 to the internal actuator 150 through the barrier layer 140. That is, the switch 100 includes a mechanism for coupling and/or associating the external actuator 170 to the internal actuator 150 through the barrier layer 140 so that movement of the external actuator 170 from the first/OFF position to the second/ON position moves the internal actuator 150 from the first/OFF position to the second/ON position, and vice-versa. As illustrated, the mechanism for coupling the external and internal actuators 170, 150 may include a plurality of magnets 200. Thus arranged, the external actuator 170 is coupled to the internal actuator 150 without any physical connection so that no opening is provided through the barrier layer 140 to ensure that ingress or intrusion of water, dust, etc. is prevented (e.g., the barrier layer 140 is devoid of any openings that would allow water, dust, etc. to enter). In use, the magnets 200 may be coupled to the internal and external actuators 150, 170 via any suitable mechanism now known or hereafter developed including, for example, adhesives. As previously mentioned, the magnets may be received within pockets formed in the front surface of the internal actuator 150 and the rear surface of the external actuator 170.

As illustrated in one embodiment, the switch 100 may include four magnets 200A, 200B, 200C, 200D. In use, the first and second magnets 200A, 200B may be coupled to the external actuator 170. The third and fourth magnets 200C, 200D may be coupled to the internal actuator 150, with the first magnet 200A being associated with the third magnet 200C and the second magnet 200B being associated with the fourth magnet 200D. In use, the first and third magnets 200A, 200C and the second and fourth magnets 200B, 200D may be arranged and configured to repel each other so that in use, movement of the external actuator 170 from the first/OFF position to the second/ON position causes the first magnet 200A to repel the third magnet 200C causing the internal actuator 150 to move from the first/OFF position to the second/ON position (e.g., movement of the external actuator 170 from the first/OFF position to the second/ON position causes the first magnet 200A to repel the third magnet 200C causing the internal actuator 150 to pivot from the first/OFF position to the second/ON position). Similarly, the second and fourth magnets 200B, 200D may be arranged and configured to repel each other so that in use, movement of the external actuator 170 from the second/ON position to the first/OFF position causes the second magnet 200B to repel the fourth magnet 200D causing the internal actuator 150 to move from the second/ON position to the first/OFF position (e.g., movement of the external actuator 170 from the second/ON position to the first/OFF position causes the second magnet 200B to repel the fourth magnet 200D causing the internal actuator 150 to pivot from the second/on position to the first/OFF position). Alternatively, the magnets 200 could be arranged and configured to attract each other.

Thus arranged, in use, the magnets 200 associated with the external and internal actuators 170, 150 are arranged and configured to drive the internal actuator 150 via movement of the external actuator 170 through the barrier layer 140 (e.g., magnets 200 transfer movement, actuation, pivoting motion, etc. of the external actuator 170 to the internal actuator 150 through the barrier layer 140). Movement of the internal actuator 150 is arranged and configured to drive the switching mechanism 160 (e.g., brush 122) (FIG. 6) to selectively energize and/or de-energize the associated load. Meanwhile, by coupling the external actuator 170 to the internal actuator 150 via magnets (e.g., a magnetic coupling), direct connection to the internal actuator 150 by the external actuator 170 is not required. As such, the barrier layer 140 can extend across the opening of the internal cavity or volume of the base 110 thereby ensuring a complete seal across the opening of the interior cavity or volume 116 of the base 110 thereby preventing ingress of water, dust, etc.

Referring to FIGS. 3-6, in one embodiment, the switch 100 may also include a gasket 220. In use, the gasket 220 is arranged and configured to seal the wall-plate 132 such as, for example, the integrated frame, 130, wall-plate 132, and barrier layer 140 to the electrical box. Thus arranged, with the integrated frame, 130, wall-plate 132, and barrier layer 140 containing no gaps or openings, the switch 100 will be completely sealed to the electrical box when installed.

While the present disclosure has been shown and described in connection with an electrical switch including a manual external actuator such as, for example, a rocker or a paddle, the features contained within the present disclosure are not so limited and may be used in other embodiments of electrical switches. For example, the incorporation of a magnetic coupling or magnets to transfer motion from an external actuator to an internal actuator can be utilized in, for example, a slider to enable dimming control, a wireless enabled switch, a toggle switch, a rotary switch, etc.

Figure 10:
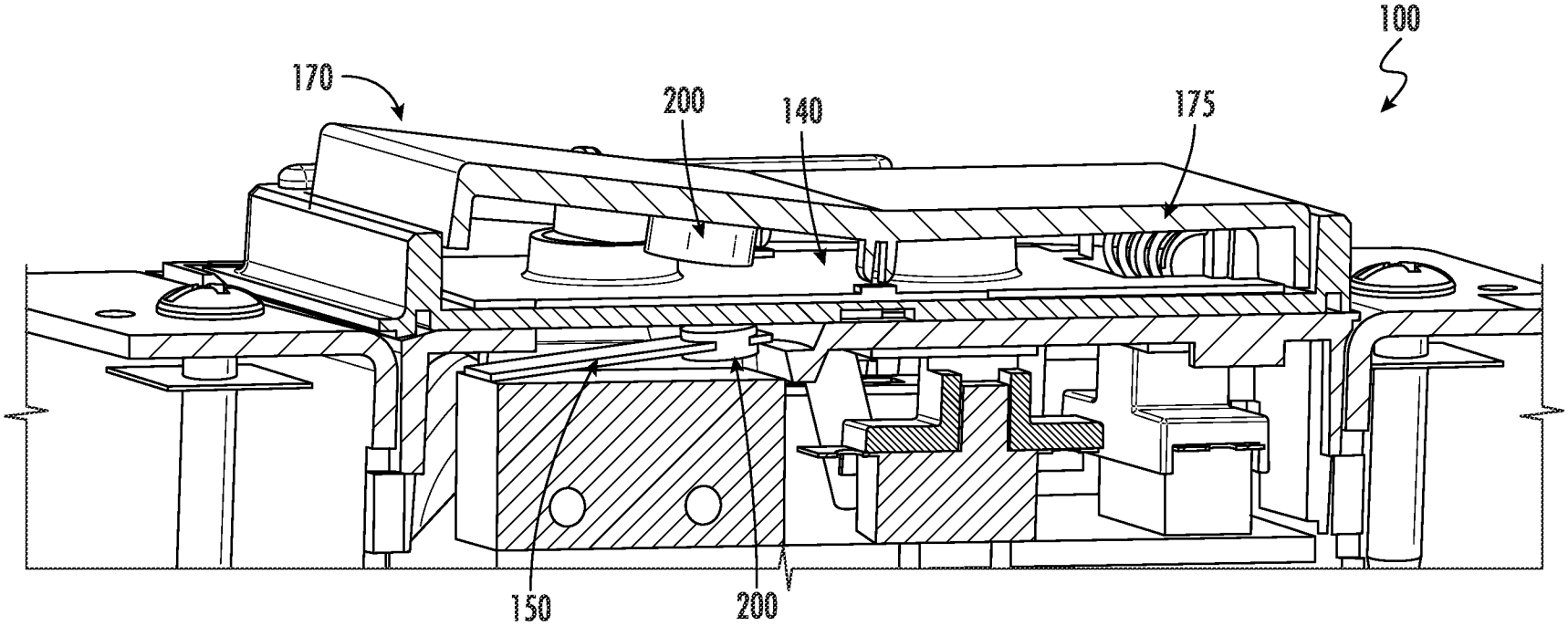
FIG. 10 illustrates a cross-sectional view of an alternate embodiment of an electrical switch according to the present disclosure.

For example, referring to FIG. 10, an electrical switch 100 may include an external actuator 170, a barrier layer or barrier 140 (terms used interchangeably herein without the intent to limit), and an internal actuator 150. In use, as previously described, the external actuator 170 includes a mechanism for coupling and/or associating the external actuator 170 to the internal actuator 150 through the barrier layer 140 so that movement of the external actuator 170 from the first/OFF position to the second/ON position moves the internal actuator 150 from the first/OFF position to the second/ON position, and vice-versa. As illustrated, the mechanism for coupling the external and internal actuators 170, 150 may include interacting magnets 200. Thus arranged, the external actuator 170 is coupled to the internal actuator 150 without any physical connection so that no opening is provided through the barrier layer 140 to ensure that ingress or intrusion of water, dust, etc. is prevented (e.g., the barrier layer 140 is devoid of any openings that would allow water, dust, etc. to enter).

As illustrated, the electrical switch 100 may only include a single pair of magnets 200 (e.g., first and second magnets 200 that interact with each other through the barrier layer 140). In use, the internal magnet 200 is attached to the internal actuator 150 and the external magnet 200 is attached to the external actuator 170. For example, as illustrated, in one embodiment, the magnet 200 on the external actuator 170 may be positioned outside the face cover, while the magnet 200 on the internal actuator 150 is positioned inside the face cover (e.g., behind the barrier layer 140). The electrical switch 100 may include a spring 175 such as, for example, a detent spring, arranged and configured to maintain the external actuator 170 in the first/OFF or second/ON position.

That is, in use, in one embodiment, as the external actuator 170 is moved to the ON state, the magnet 200 associated with the external actuator 170 interacts with the magnet 200 associated with the internal actuator 150 to create a force such as, for example, a repulsive force, to move or actuate the internal actuator 150 through the barrier layer 140 thereby turning the connected load such as, for example, lights, to the ON state (e.g., the magnet 200 on the external actuator 170 may have the same polarity as the magnet 200 on the internal actuator 150). When the external actuator 170 is moved to the OFF state, the magnet 200 associated with the external actuator 170 interacts with the magnet 200 associated with the internal actuator 150 to create a force to move or actuate the internal actuator 150 thereby turning the connected load such as, for example, lights, to the OFF state With reference to FIG. 11, in one or more various embodiments, an electrical switch 100 may further include a slider mechanism 250 arranged and configured to DIM UP or DIM DOWN the connected electrical load such as, for example, the lights, as will be readily appreciated by one of ordinary skill in the art. As will be appreciated by one of ordinary skill in the art, the slider mechanism 200 may be used in combination with any electrical switch disclosed herein.

As illustrated, in one embodiment, the slider mechanism 250 includes an external slider 252 accessible to the user and an internal slider 254 such as, for example, a potentiometer, positioned within the housing of the electrical switch 100 behind the barrier layer 140. In use, movement of the external slider 252 is transferred to the internal slider 254 through the barrier layer 140 via magnets 256, 258 associated with the external and internal sliders 252, 254, respectively.

Figure 11:
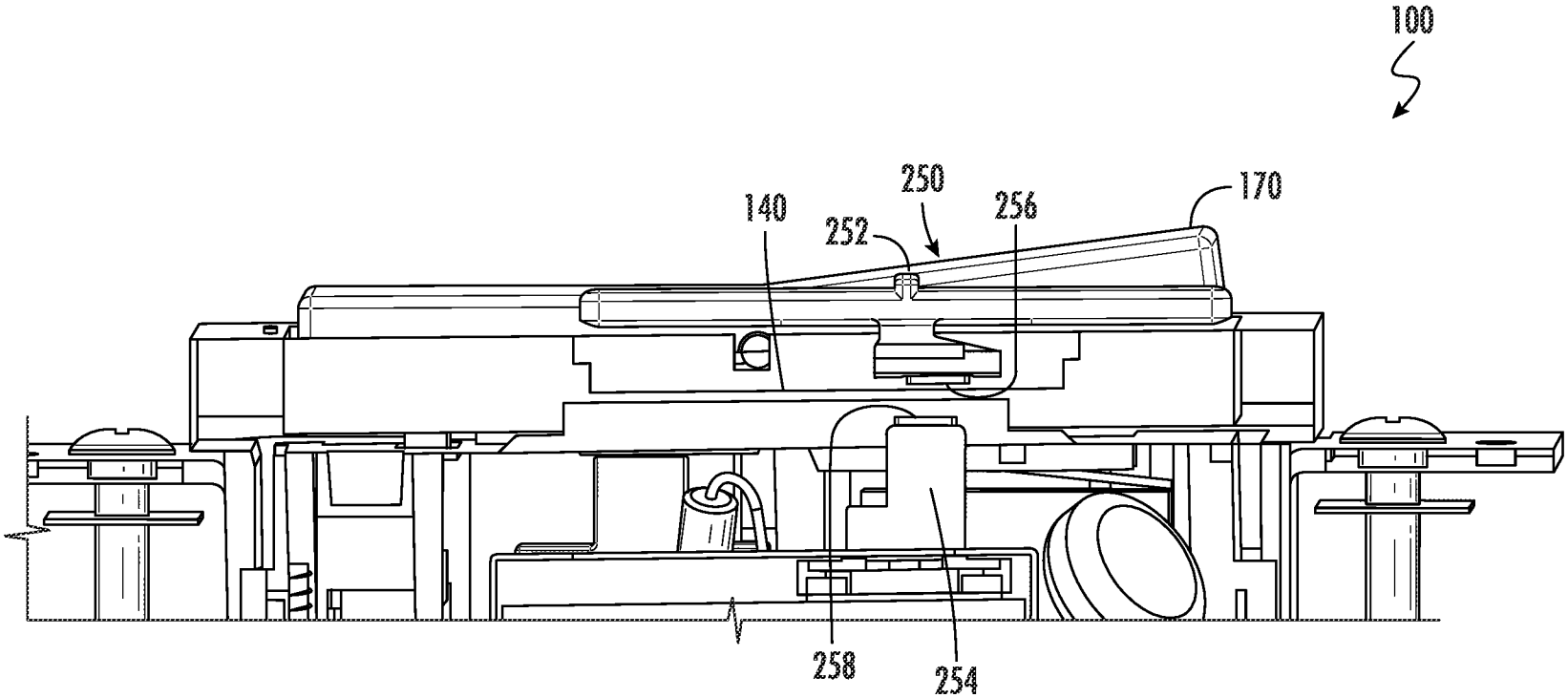
FIG. 11 illustrates a cross-sectional views of an alternate embodiment of an electrical switch according to the present disclosure, the electrical switch incorporating a slider mechanism.

In use, in one embodiment, the external slider 252 is positioned within a track formed in the electrical switch 100. As illustrated in FIG. 11, a magnet 256 is coupled to the external slider 252. A complimentary magnet 254 is associated with an internal slider (e.g., a potentiometer) 254, which is positioned directly underneath the external slider 252. In use, the interaction (e.g., attractive force) between the magnets 256, 258 cause the potentiometer 254 to move as the slider 252 is moved.

Figure 12A:
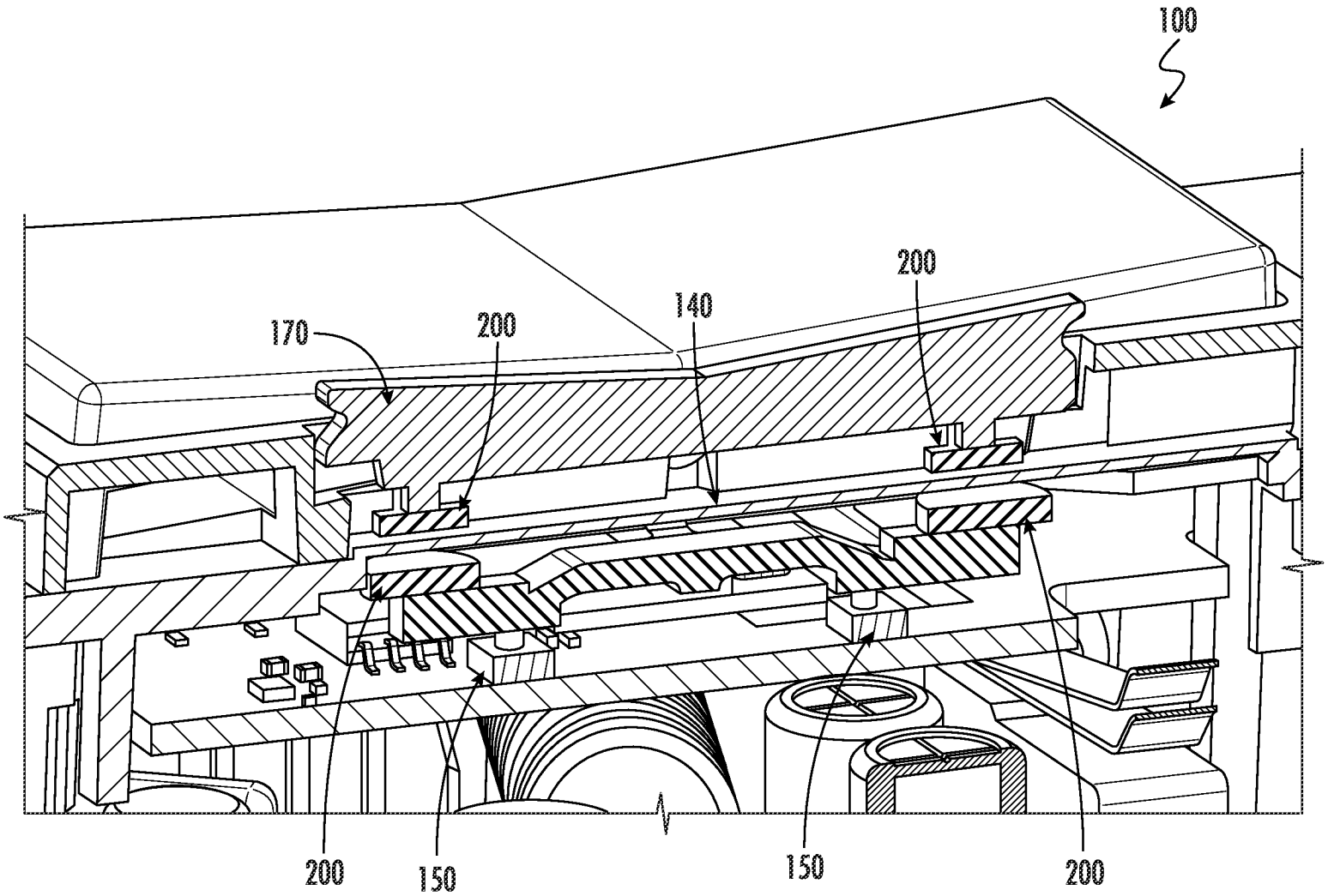
FIGS. 12A and 12B illustrate cross-sectional views of an alternate embodiment of an electrical switch according to the present disclosure.
Figure 12B:
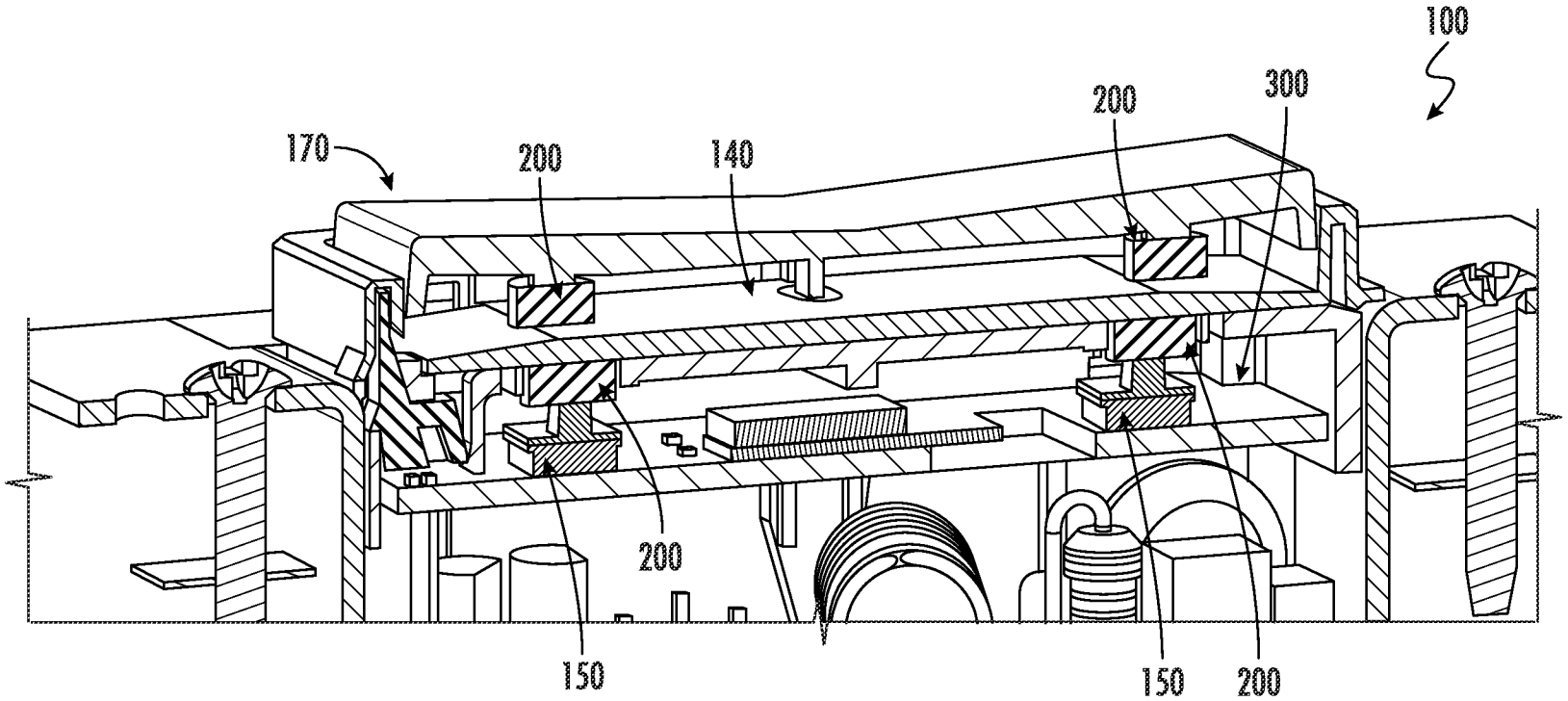

Referring to FIGS. 12A and 12B, the electrical switch 100 may be provided in the form of a wireless enable electrical switch. Such as, for example, a Wi-Fi enabled switch. As illustrated, in one embodiment, the electrical switch 100 includes an external actuator 170, a barrier layer 140, and an internal actuator 150, which may be in the form of micro-switches or momentary switches positioned on a printed-circuit board (PCB) 300. In use, as previously described, the external actuator 170 includes a mechanism for coupling the external actuator 170 to the internal actuator 150 through the barrier layer 140 so that movement of the external actuator 170 from the first/OFF position to the second/ON position moves the internal actuator 150 from the first/OFF position to the second/ON position, and vice-versa. As illustrated, the mechanism for coupling the external and internal actuators 170, 150 may include a plurality of magnets 200. As previously described, in use, as the external actuator 170 is moved to either the ON or OFF state, magnets 200 associated with the external actuator 170 interact with magnets 200 on the internal actuator 150 to create a force such as, for example, a repulsive force, to move or actuate the internal actuator 150.

Figure 13:
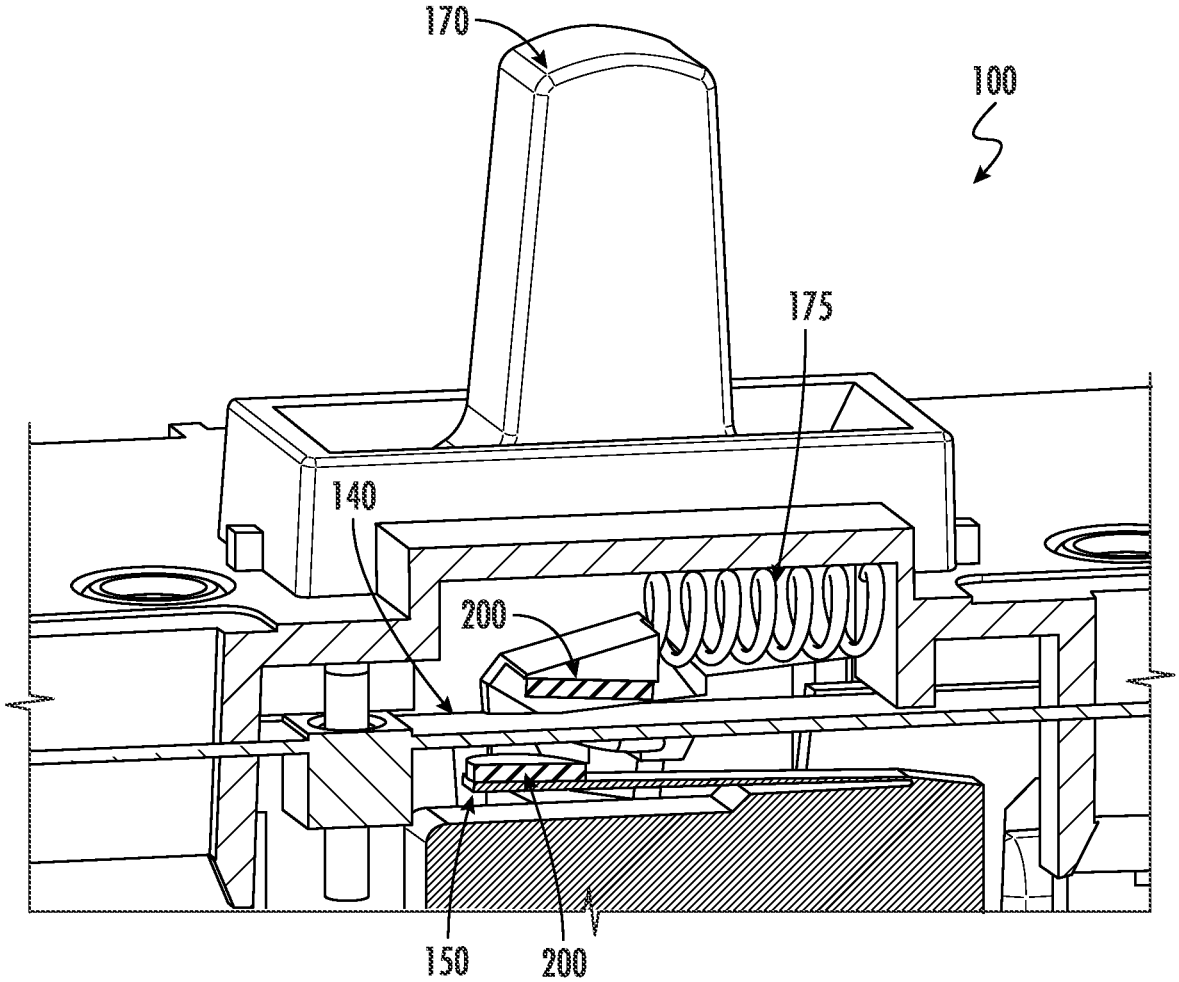
FIG. 13 illustrates a cross-sectional view of an alternate embodiment of an electrical switch according to the present disclosure.

Referring to FIG. 13, the electrical switch 100 may include an external actuator 170 in the form of a toggle switch. For example, as illustrated, the electrical switch 100 includes an external actuator or toggle switch 170, a barrier layer 140, and an internal actuator 150. In use, as previously described, the external actuator or toggle switch 170 includes a mechanism for coupling the external actuator 170 to the internal actuator 150 through the barrier layer 140 so that movement of the external actuator 170 from the first/OFF position to the second/ON position moves the internal actuator 150 from the first/OFF position to the second/ON position, and vice-versa. As illustrated, the mechanism for coupling the external and internal actuators 170, 150 may include interacting magnets 200. As previously described, in use, as the external actuator 170 is moved to the ON state, a first magnet 200 associated with the external actuator 170 interacts with a second magnet 200 on the internal actuator 150 to create a force such as, for example, a repulsive force, to move or actuate the internal actuator 150 (e.g., the magnet on the external actuator 170 may have the same polarity as the magnet 200 on the internal actuator 150). A spring 175 such as, for example, a detent spring may be incorporated to maintain the external actuator 170 in the first or second position. Thus arranged, in use, when the external actuator or toggle switch 170 is moved to, for example, the OFF state, the magnet 200 associated with the internal actuator 150 is a distance far enough from the magnet 200 associated with the external actuator or toggle switch 170 that the repulsive force between the magnets 200 is less than the operating force of the spring.

As illustrated, in one embodiment, the magnet 200 associated with the external actuator or toggle switch 170 is positioned outside, and thus may be exposed to water, etc. However, the magnet 200 on the internal actuator 150 is positioned inside of the face cover (e.g., behind the barrier layer 140) and thus protected from the environment.

Figure 14A:
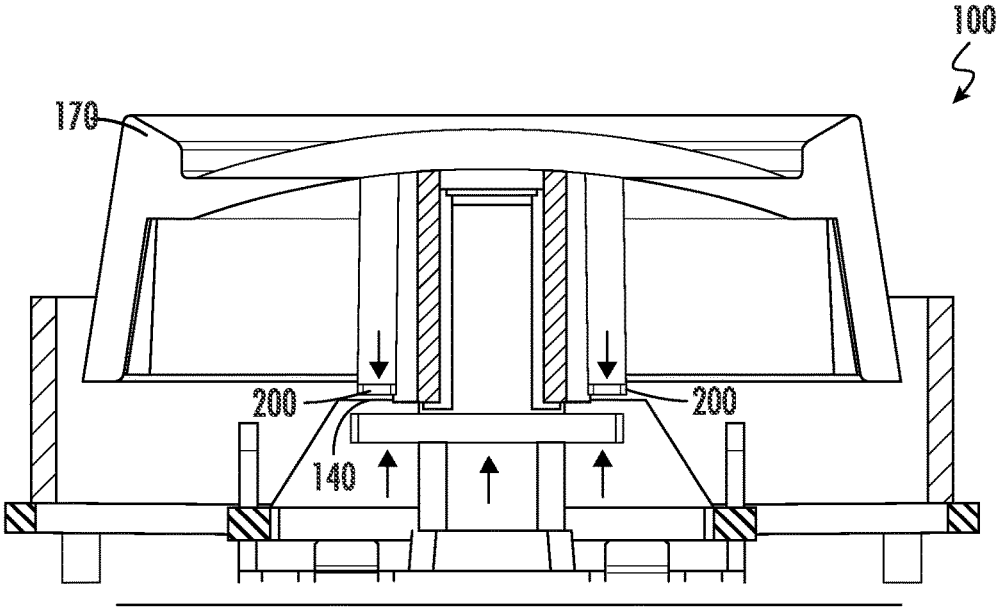
FIGS. 14A and 14B illustrate cross-sectional views of an alternate embodiment of an electrical switch according to the present disclosure.
Figure 14B:
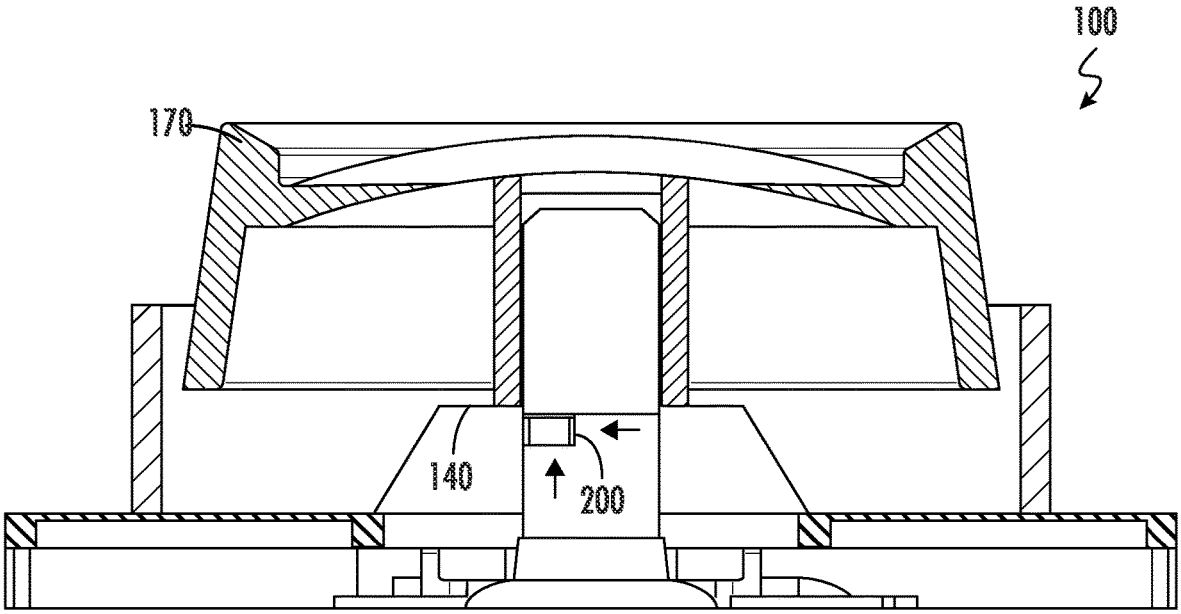

Referring to FIGS. 14A and 14B, the electrical switch 100 may include an external actuator 170 in the form of a rotary switch. In use, the rotary switch is rotated between the first/OFF position and the second/ON position. As illustrated, in one embodiment, the rotary switch may include a plurality of magnets 200 to transfer motion from the rotary switch (e.g., knob) to the internal actuator 150 through the barrier layer 140 so that movement of the rotary switch (e.g., knob) moves (e.g., rotates) the internal actuator 150. In one embodiment, the rotary switch (e.g., knob) may include first and second magnets 200 associated therewith. The internal actuator 150 may be include, for example, a single long magnet 200 mounted to the face of the internal actuator (e.g., potentiometer) 150. In use, rotation of the rotary switch (e.g., knob) about the center of the potentiometer causes the internal actuator (e.g., potentiometer) to rotate. In use, the magnet forces keep the smaller magnets associated with the rotary switch (e.g., knob) aligned with the longer magnet associated with the internal actuator (e.g., potentiometer). As illustrated, in one embodiment, the potentiometer and larger magnet are positioned inside the face cover, while the rotary switch (e.g., knob) and small magnets associated therewith are positioned outside of the face cover.

In an alternate embodiment, an interchangeable frame (e.g., a color change kit) can be incorporated to allow a user to remove and replace or change the external actuator. This may be advantageous in that it can allow a user to change the color, texture, or appearance of the device. Such an interchangeable frame has the additional benefit of allowing a user to repair the user interface portion of the electrical switch without having to replace the entire electrical switch or access live electrical components. In this embodiment, the electrical switch may include an interchangeable frame assembly having an external actuator with magnets and a wallplate, and a base assembly. The base assembly having a base for enclosing the electrical circuitry and/or internal components, an internal actuator with magnets, and a barrier layer arranged and configured to seal the internal components and/or circuitry of the base from the external environment. The magnets are for transferring movement of the external actuator to the internal components and/or circuitry through the barrier layer for selectively controlling the associated load.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more embodiments for the purpose of streamlining the disclosure. However, it should be understood that various features of the certain embodiments of the disclosure may be combined in alternate embodiments. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority, but are used to distinguish one feature from another. The drawings are for purposes of illustration only and the dimensions, positions, order and relative to sizes reflected in the drawings attached hereto may vary.

What is claimed is:

1. An electrical device comprising:

a base including an opening and a cavity;

an internal actuator positioned at least partially within the cavity of the base;

an external actuator accessible by a user;

a barrier positioned between the internal actuator and the external actuator, the barrier arranged and configured to cover the opening of the base, the barrier configured to seal the cavity to prevent ingress of water and dust; and a magnet coupled to one or both of the internal actuator and the external actuator, wherein the magnet is arranged and configured to magnetically couple the internal actuator and the external actuator, wherein upon movement of the external actuator, the magnetic coupling causes movement of the internal actuator.

2. The electrical device of claim 1, wherein the external actuator is moveable between a first position and a second position and the internal actuator is moveable between a first position and a second position, wherein movement of the external actuator between the first and second positions causes the internal actuator to move between its respective first and second positions.

3. The electrical device of claim 2, wherein the electrical device is an electrical switch and the external actuator is one of an external rocker, an external paddle, or a toggle, the external actuator being manually moveable between the first and second positions to selectively energize and de-energize an electrical load coupled to the electrical device.

4. The electrical device of claim 2, wherein the electrical device is an electrical switch, the external actuator is an external slider, and the internal actuator is an internal slider; wherein upon movement of the external slider, the magnetic coupling causes movement of the internal slider between the first and second positions to control an electrical load coupled to the electrical device.

5. The electrical device of claim 2, wherein the electrical device is an electrical switch, the external actuator is a rotary actuator rotatable between the first and second positions to selectively energize and de-energize an electrical load coupled to the electrical device.

6. The electrical device of claim 1, wherein the magnet further comprises a first magnet coupled to the external actuator and a second magnet coupled to the internal actuator.

7. The electrical device of claim 1, wherein the magnet further comprises first and second magnets coupled to the external actuator and third and fourth magnets coupled to the internal actuator.

8. The electrical device of claim 7, wherein the first magnet is arranged and configured to repel the third magnet and the second magnet is arranged and configured to repel the fourth magnet.

9. The electrical device of claim 7, wherein the first magnet is arranged and configured to attract the third magnet and the second magnet is arranged and configured to attract the fourth magnet.

10. The electrical device of claim 1, further comprising a frame coupled to the base, wherein the internal actuator is coupled to the base and the external actuator is coupled to the frame.

11. The electrical device of claim 10, wherein the frame and the barrier are integrally formed.

12. The electrical device of claim 11, further comprising a wall-plate arranged and configured to couple the device to an electrical box, the wall-plate being integrally formed with the frame and the barrier.

13. The electrical device of claim 1, wherein the barrier comprises a film or membrane.

14. The electrical device of claim 1, wherein the magnet is a permanent magnet.

15. An electrical switch comprising:

a base including an opening and a cavity;

a switching mechanism positioned with the cavity, the switching mechanism arranged and configured to selectively energize and de-energize an electrical load coupled to the electrical device;

an internal actuator positioned within the cavity of the base;

an external actuator accessible by a user, the external actuator moveable between a first position and a second position;

a barrier positioned between the internal actuator and the external actuator, the barrier arranged and configured to cover the opening of the base, the barrier configured to seal the cavity; and a magnet coupled to one or both of the internal actuator and the external actuator, wherein the magnet is arranged and configured to magnetically couple the internal actuator and the external actuator, wherein upon movement of the external actuator, the magnetic coupling causes movement of the internal actuator between its first and second positions.

16. The electrical switch of claim 15, wherein the magnet further comprises a first magnet coupled to the external actuator and a second magnet coupled to the internal actuator.

17. The electrical switch of claim 15, wherein the magnet further comprises first and second magnets coupled to the external actuator and third and fourth magnets coupled to the internal actuator.

18. The electrical switch of claim 15, further comprising a frame coupled to the base, wherein the internal actuator is coupled to the base and the external actuator is coupled to the frame.

19. The electrical switch of claim 18, wherein the frame and the barrier are integrally formed.

20. The electrical switch of claim 19, further comprising a wall-plate arranged and configured to couple the switch to an electrical box, the wall-plate being integrally formed with the frame and the barrier.

* * * * *